US009318048B2

(12) United States Patent
Ma

(10) Patent No.: US 9,318,048 B2
(45) Date of Patent: Apr. 19, 2016

(54) PIXEL CIRCUIT AND DISPLAY APPARATUS

(71) Applicant: BOE TECHNOLOGY GROUP CO., LTD., Beijing (CN)

(72) Inventor: Zhanjie Ma, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 130 days.

(21) Appl. No.: 14/063,093

(22) Filed: Oct. 25, 2013

(65) Prior Publication Data

US 2014/0118420 A1 May 1, 2014

(30) Foreign Application Priority Data

Oct. 26, 2012 (CN) ..... 2012 1 0418427

(51) Int. Cl.
*G09G 3/32* (2006.01)

(52) U.S. Cl.
CPC ..... *G09G 3/3233* (2013.01); *G09G 2300/0819* (2013.01); *G09G 2310/0251* (2013.01); *G09G 2320/045* (2013.01); *G09G 2320/0626* (2013.01)

(58) Field of Classification Search
CPC ..... G09G 3/3208–3/3291
See application file for complete search history.

(56) References Cited

U.S. PATENT DOCUMENTS

2005/0068271 A1* 3/2005 Lo ..... G09G 3/3233 345/76
2005/0105031 A1* 5/2005 Shih ..... G09G 3/3233 349/139
2010/0117937 A1* 5/2010 Kim ..... G09G 3/3233 345/76
2011/0169798 A1* 7/2011 Lee ..... G09G 3/3233 345/211
2012/0162275 A1* 6/2012 Park ..... H01L 27/3262 345/690

FOREIGN PATENT DOCUMENTS

CN 102855264 A 1/2013

OTHER PUBLICATIONS

First Chinese Office Action Appln. No. 201210418427.4; Dated Oct. 10, 2014.

* cited by examiner

*Primary Examiner* — Sanjiv D Patel
(74) *Attorney, Agent, or Firm* — Ladas & Parry LLP

(57) ABSTRACT

Provided are a pixel circuit and a display apparatus. The pixel circuit comprises a charging sub-circuit, a driving sub-circuit and a light-emitting control sub-circuit; wherein the driving sub-circuit comprises a reference signal source, a driving transistor, a capacitor and a light-emitting device; the charging sub-circuit has a first terminal connected to a source of the driving transistor, a second terminal connected to a drain of the driving transistor, and a third terminal connected to a gate of the driving transistor and one terminal of the capacitor; the light-emitting control sub-circuit comprises a first terminal connected to an output terminal of the reference signal source and the other terminal of the capacitor, a second terminal connected to the source of the driving transistor, a third terminal connected to one terminal of the light-emitting device, and a fourth terminal connected to the drain of the driving transistor.

8 Claims, 5 Drawing Sheets

PIXEL CIRCUIT AND DISPLAY APPARATUS

TECHNICAL FIELD

The present disclosure relates to the technical field of organic light-emitting, and particularly to a pixel circuit and a display apparatus.

BACKGROUND

An Organic Light Emitting Diode (OLED) display receives much attention for its advantages such as low power consumption, high luminance, low cost, wide viewing angle and fast response and the like, and thus it has been widely used in the technical field of organic light-emitting.

However, in the OLED display, there are the following inevitable problems. Firstly, it is possible that a threshold voltage $V_{th}$ of each of transistors for the displaying of an image on an array substrate drifts due to the non-uniformities in structure, electrical capability and stability which are introduced during the manufacturing process of the array substrate. Secondly, the stability of the transistor would decrease if it were turned on for a long time. In addition, a load of a signal line increases accordingly with the development of a large scale OLED in size, which results in an attenuation in voltage on the signal line, e.g., the changing of an operating voltage.

When an OLED is driven to operate by an existing pixel circuit structure for driving OLED to emit light, the current flowing through the OLED depends on the threshold voltage $V_{th}$ of a driving transistor, and/or the stability of the driving transistor, and/or a reference voltage $V_{DD}$. Even if the same driving signal is applied to each pixel, the currents flowing through individual OLEDs on a display area of the array substrate might be unequal to each other, which results in non-uniformity in the luminance of the OLEDs on the array substrate, and thus causes non-uniformity in image luminance.

SUMMARY

Embodiments of the present invention provide a pixel circuit and a display apparatus, for improving the uniformity of the image luminance in the display area of the display apparatus.

According to one aspect of the present disclosure, the embodiments of the present disclosure provide a pixel circuit comprising a charging sub-circuit, a driving sub-circuit and a light-emitting control sub-circuit;

wherein the driving sub-circuit comprises a reference signal source, a driving transistor, a capacitor and a light-emitting device; one terminal of the capacitor is connected to a gate of the driving transistor, and the other terminal of the capacitor is connected to an output terminal of the reference signal source; a first terminal of the light-emitting control sub-circuit is connected to the output terminal of the reference signal source, a second terminal of the light-emitting control sub-circuit is connected to a source of the driving transistor, a third terminal of the light-emitting control sub-circuit is connected to one terminal of the light-emitting device, and a fourth terminal of the light-emitting control sub-circuit is connected to a drain of the driving transistor; a first terminal of the charging sub-circuit is connected to the source of the driving transistor, a second terminal of the charging sub-circuit is connected to the drain of the driving transistor, and a third terminal of the charging sub-circuit is connected to the gate of the driving transistor;

wherein the charging sub-circuit is used for charging the capacitor of the driving sub-circuit, the light-emitting control sub-circuit is used for controlling the driving sub-circuit to be turned on so as to discharge the capacitor and drive the light-emitting device to emit light.

According to another aspect of the present disclosure, the embodiments of the present disclosure provide a display apparatus comprising the above pixel circuit.

The embodiments of the present disclosure provide a pixel circuit comprising a charging sub-circuit, a driving sub-circuit and a light-emitting control sub-circuit; wherein the driving sub-circuit comprises a driving transistor, a light-emitting device, a capacitor and a reference signal source; when the pixel circuit is in a phase for writing data signal, a voltage GND output from the reference signal source is applied to one terminal of the capacitor at which the capacitor is connected to the reference signal source, the charging sub-circuit outputs a voltage $V_{DATA}$ corresponding to the data signal, and charges the capacitor with the voltage $V_{DATA}$; when the pixel circuit is in a phase for emitting light, the light-emitting control sub-circuit controls the reference signal source to be connected electrically to the source of the driving transistor, and controls the light-emitting device to be connected electrically to the drain of the driving transistor, so that the reference voltage output from the reference signal source is applied to the source of the driving transistor, the capacitor is discharged, the driving transistor is turned on according to the reference voltage applied to the source thereof and the voltage corresponding to the discharging of the capacitor, and the light-emitting device is driven to emit light. The voltage driving the light-emitting to emit light only depends on the voltage $V_{DATA}$ and is independent of the threshold voltage $V_{th}$ of the pixel and the reference voltage, and thus there is no influence of the voltage $V_{th}$ and the reference voltage on the current of the light-emitting device; when the same data signal is input to the different pixels, the same image luminance is obtained, and thus the uniformity of the image luminance in the display area of the display apparatus is improved.

DETAILED DESCRIPTION OF THE PREFERRED EMBODIMENTS

The embodiments of the present disclosure provide a pixel circuit and a display apparatus for improving the uniformity of the image luminance in the display area of the display apparatus.

The pixel circuit provided in the embodiments of the present disclosure is adapted to drive each of pixels in the display apparatus to implement displaying of an image.

A driving transistor in the pixel circuit provided in the embodiments of the present disclosure can be a Thin Film Transistor (TFT) or a Metal Oxide Semiconductor Filed Effect Transistor (MOSFET). The driving transistor can be an n type transistor or a p type transistor.

An Organic Light-Emitting Diode in the embodiments of the present disclosure receives a driving current supplied from the driving transistor of n type or p type to emit light for displaying an image. The pixel circuit provided in the embodiments of the present disclosure can ensure that, during a phase for emitting light, the driving voltage for driving the OLED to emit light is equal to a voltage $V_{DATA}$ supplied by a data signal source, and is independent of the reference voltage $V_{DD}$ or $V_{SS}$, or the threshold voltage $V_{th}$ of the driving transistor. Even though there are non-uniformities in the parameters of the driving transistor, decreasing stability, or heavy load on the signal line during the manufacturing process of the array substrate of the display apparatus, the uniformity of the currents in the display area would not be affected, thus improving the evenness of the image luminance in the display area of the display apparatus.

Hereinafter, the technical solution provided in the embodiments of the present disclosure is described in detail with reference to the accompanying drawings.

Figure 1:
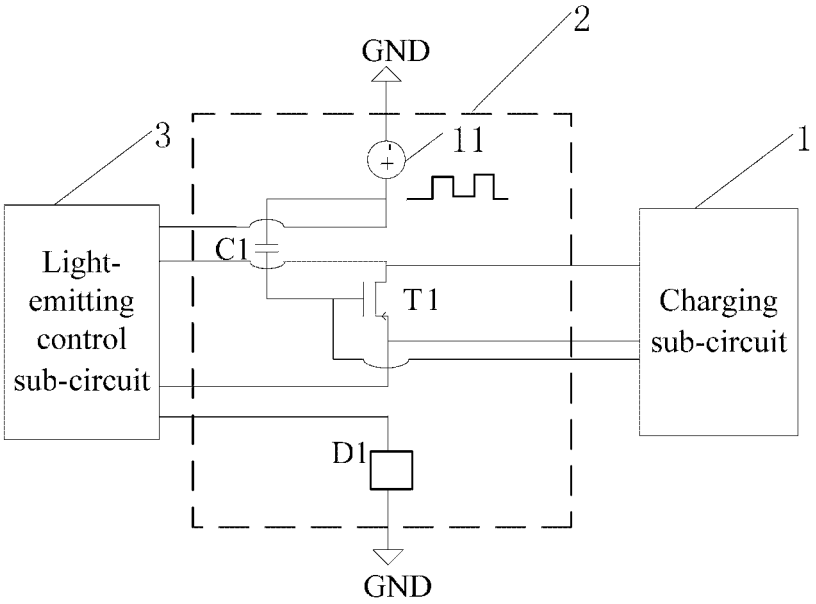
FIG. 1 is a schematic diagram showing a pixel circuit structure provided in an embodiment of the present disclosure.

As shown in FIG. 1, a pixel circuit provided in an embodiment of the present disclosure includes a charging sub-circuit 1, a driving sub-circuit 2, and a light-emitting control sub-circuit 3.

For instance, the driving sub-circuit 2 comprises a reference signal source 11, a driving transistor T1, a capacitor C1, and a light-emitting device, such as an Organic Light-Emitting Diode (OLED) D1.

As an example, the light-emitting control sub-circuit 3 has four terminals, wherein a first terminal of the light-emitting control sub-circuit 3 is connected to an output terminal of the reference signal source 11, a second terminal thereof is connected to a source of the driving transistor T1, a third terminal thereof is connected to one terminal of the light-emitting device D1, and a fourth terminal thereof is connected to a drain of the driving transistor T1; the capacitor C1 has one terminal connected to a gate of the driving transistor T1, and the other terminal connected to the output terminal of the reference signal source 11; the charging sub-circuit 1 has a first terminal connected to the source of the driving transistor T1, a second terminal connected to the drain of the driving transistor T1, and a third terminal connected to the gate of the driving transistor T1.

When the pixel circuit operates in a phase for writing data signal, the charging sub-circuit 1 outputs a voltage $V_{DATA}$ corresponding to the data signal, applies the voltage $V_{DATA}$ to the terminal of the capacitor C1 at which the capacitor C1 is connected to the gate of the driving transistor T1, and charges the capacitor C1 so that the data signal is written into the pixel circuit.

When the pixel circuit operates in a phase for emitting light, the light-emitting control sub-circuit 3 controls the branch comprising the driving transistor T1 and the OLED D1 to switch into conduction; in the branch, the reference voltage $V_{ref}$ output from the reference signal source 11 is applied to the source of the driving transistor T1, the capacitor C1 is discharged, and the driving transistor T1 is turned on according to the reference voltage $V_{ref}$ applied to the source of the driving transistor T1 and the voltage applied to the gate thereof corresponding to the discharging of the capacitor C1, so that the OLED D1 is driven to emit light.

The driving transistor T1 can be a p type transistor or a n type transistor.

The pixel circuit provided in the embodiments of the present disclosure and the principle of driving the OLED to emit light are illustrated hereinafter with taking the case wherein individual switching transistors and the driving transistor T1 are p type transistors as an example.

For a driving transistor of p type, $V_{DD}$ is a positive value, $V_{DATA}$ is a positive value and $V_{th}$ is a negative value.

When the driving transistor T1 is a p type transistor, the reference signal source is a positive reference signal source which provides a pulse of positive voltage $V_{DD}$, wherein the drain of the driving transistor T1 is connected to an anode of the OLED D1, and the cathode of the OLED D1 is connected to a low level signal source.

Preferably, the cathode of the OLED D1 is connected to a grounding signal source (GND).

Figure 2:
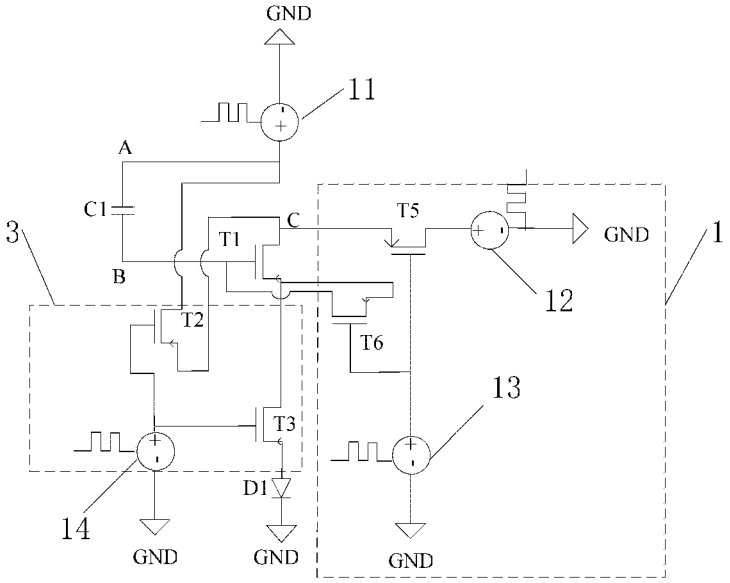
FIG. 2 is a schematic diagram showing a detailed pixel circuit structure provided in an embodiment of the present disclosure.

As shown in FIG. 2, the charging sub-circuit 1 comprises a data signal source 12, a gate signal source 13, a switching transistor T5 and a switching transistor T6.

The switching transistor T5 has a source connected to an output terminal of the data signal source 12, a drain connected to the source of the driving transistor T1, and a gate connected to an output terminal of the gate signal source 13.

The switching transistor T6 has a source connected to the gate of the driving transistor T1, a drain connected to the drain of the driving transistor T1, and a gate connected to the output terminal of the gate signal source 13.

In particular, when the pixel circuit operates in the phase for writing data signal, the voltage GND output from the reference signal source 11 is applied to the terminal of the capacitor C1 at which the capacitor C1 is connected to the reference signal source 11; the gate signal source 13 controls the switching transistors T5 and T6 to be turned on; the data signal source 12 of the charging sub-circuit 1 outputs a voltage $V_{DATA}$ corresponding to the data signal, and applies the voltage $V_{DATA}$ to the source of the driving transistor T1; the voltage at the gate of the driving transistor T1 is equal to $V_{DATA}+V_{th}$, and the voltage of the terminal of the capacitor C1 at which the capacitor C1 is connected to the driving transistor T1 is charged to $V_{DATA}+V_{th}$.

As shown in FIG. 2, the driving sub-circuit 2 comprises the reference signal source 11, the driving transistor T1, the capacitor C1 and the light-emitting device D1.

The drain of the driving transistor T1 is connected to the light-emitting control sub-circuit 3, the source thereof is connected to the charging sub-circuit 1, and the gate thereof is connected to the terminal B of the capacitor C1; the terminal A of the capacitor C1 is connected to the reference signal source 11, and the light-emitting device D1 is connected to the light-emitting control sub-circuit 3.

The charging sub-circuit 1 is used for charging the capacitor C1 of the driving sub-circuit 2, and the light-emitting control sub-circuit 3 is used to control the driving sub-circuit 2 to switch into conduction, so that the capacitor C1 is discharged and the light-emitting device D1 is driven to emit light.

As shown in FIG. 2, the light-emitting control sub-circuit 3 includes a light-emitting signal source 14, a switching transistor T3 and/or a switching transistor T2.

The switching transistor T3 has a source connected to the drain of the driving transistor T1, a drain connected to the anode of the OLED D1, and a gate connected to an output terminal of the light-emitting signal source 14.

The switching transistor T2 has a source connected to the output terminal of the reference signal source 11, and a drain connected to the source of the driving transistor T1, and a gate connected to the output terminal of the light-emitting signal source 14.

In the case that the light-emitting control sub-circuit 3 only comprises the light-emitting signal source 14 and the switching transistor T3, the light-emitting signal source 14 controls the turning-on and turning-off of the switching transistor T3 to ensure that the OLED D1 connected to the switching transistor T3 is disconnected from the charging sub-circuit 1 when the charging sub-circuit 1 is in conduction, so that the OLED D1 does not emit light when the pixel circuit is in the phase for writing data signal.

In the case that the light-emitting control sub-circuit 3 only comprises the light-emitting signal source 14 and the switching transistor T2, the light-emitting signal source 14 controls the turning-on and turning-off of the switching transistor T2 to ensure that the driving transistor T1 connected to the switching transistor T2 is disconnected from the charging sub-circuit 1 when the charging sub-circuit 1 is in conduction, so that the driving transistor T1 is turned off when the pixel circuit is in the phase for writing data signal.

Preferably, the light-emitting control sub-circuit 3 comprises the light-emitting signal source 14, the switching transistor T3 and the switching transistor T2; when the pixel circuit is in the phase for writing data signal, the light-emitting signal source 14 controls the switching transistor T3 and the switching transistor T2 to be turned off, and the driving sub-circuit 2 connected to the switching transistor T3 and the switching transistor T2 is in an open circuit state; in the phase for emitting light, the light-emitting signal source 14 controls the switching transistor T3 and the switching transistor T2 to be turned on, the branch connected to the switching transistor T3 and the switching transistor 12 is in conduction, and the voltage $V_{DD}$ output from the reference signal source 11 is applied to the source of the driving transistor T1; at this time, due to the retention capability of the capacitor for voltage, the voltage at the gate of the driving transistor T1 is equal to $V_{DD}+V_{DATA}+V_{th}$, and thus the driving transistor T1 is turned on and the OLED D1 is driven to emit light.

It should be noted that the pixel circuit can also exclude the switching transistor T3 and/or the switching transistor T2 of the light-emitting control sub-circuit 3, and in this case, the switching transistor T3 and/or the switching transistor T2 are/is replaced by wire(s) to realize conduction, and thus implementing the processes of writing data signal and emitting light. The function of the switching transistor T2 is to reduce and avoid the interference of the reference signal source 11 on the driving transistor T1 during the phase for writing data signal, such as the $V_{DD}$ IR Drop on the signal line of $V_{DD}$ due to the load on the signal line of $V_{DD}$. Similarly, the function of the switching transistor T3 is to reduce and avoid the influence of the voltage drop ($V_{oled}$) of the OLED D1 on the writing of the data signal during the phase for writing data signal.

The light-emitting control sub-circuit 3 can prevent the pixel circuit from having any influence on the driving sub-circuit during the phase for writing data signal. The pixel circuit shown in FIG. 2 is based on a preferable embodiment of the present disclosure.

Figure 3:
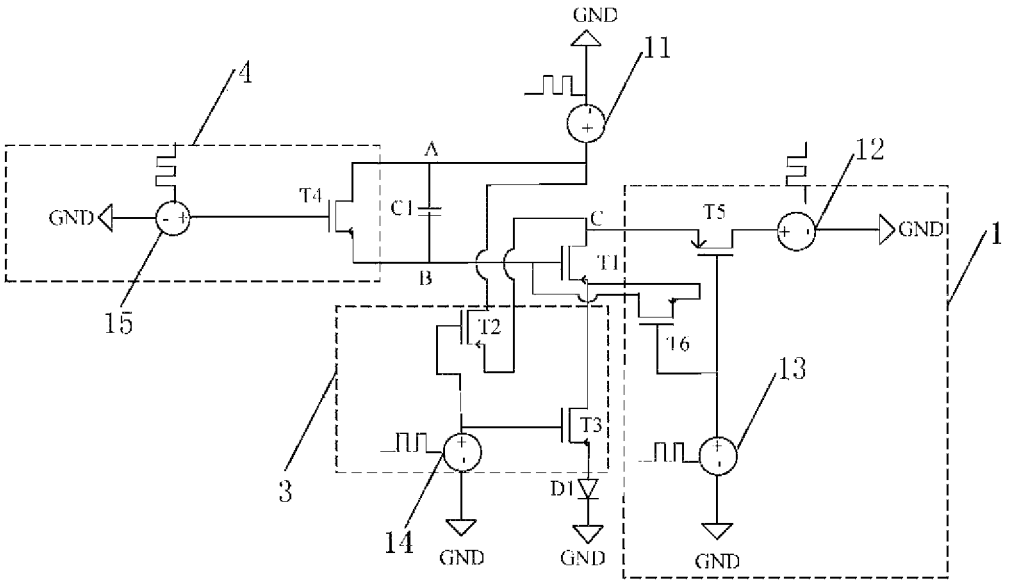
FIG. 3 is a schematic diagram showing a pixel circuit structure having a resetting function provided in an embodiment of the present disclosure.

As shown in FIG. 3, in order to guarantee that the signal of a previous frame has a minimum influence over the signal of a current frame, the pixel circuit provided in the embodiment of the present disclosure further includes a reset circuit 4 for resetting the voltage across the capacitor C1 to a reference reset voltage, for example, a ground potential GND, before the charging sub-circuit 1 charges the capacitor C1 (that is, the gate of the driving transistor T1 is reset to the ground potential).

The reset circuit 4 comprises a reset signal source 15 and a reset transistor T4.

A source of the reset transistor T4 is connected to a reference reset voltage source, a drain of the reset transistor T4 is connected to the gate of the driving transistor T1, and a gate of the reset transistor T4 is connected to the reset signal source 15, wherein the reference reset voltage source is used for supplying the reference reset voltage.

The reset signal source 15 controls the reset transistor T4 to be turned on, and applies the reference reset voltage supplied from the reference reset voltage source to the gate of the driving transistor T1 so as to reset the potential at the gate of the driving transistor T1 to the reference reset voltage.

The reference reset voltage source is the reference signal source 11 or a separate constant voltage source; in the case that the reference reset voltage source is the reference signal source 11, the potential at the gate of the driving transistor T1 is reset to the ground potential GND.

As shown in FIG. 3, the reference signal source 11 is connected to the source of the reset transistor T4; in the phase for resetting pixel circuit, the voltage GND output from the reference signal source 11 is applied to the terminal of the capacitor C1 at which the capacitor C1 is connected to the gate of the driving transistor T1, so that the gate of the driving transistor T1 is reset to the ground potential GND.

In particular, the source of the reset transistor T4 is connected to the output terminal of the reference signal source 11, the drain of the reset transistor T4 is connected to the gate of the driving transistor T1, and the gate of the reset transistor T4 is connected to the reset signal source 15.

When the pixel circuit is in the phase for resetting, the charging sub-circuit 1 controls the switching transistor T5 and the switching transistor T6 to be turned off, the light-emitting signal source 14 in the light-emitting control sub-circuit 3 controls the switching transistor T3 and the switching transistor T2 to be turned off, and the voltage GND supplied from the reference signal source 11 is applied to the terminal of the capacitor C1 at which the capacitor C1 is connected to the reference signal source 11;

The reset signal source 15 controls the reset transistor T4 to be turned on, and the voltage GND supplied from the reference signal source 11 is applied to the terminal of the capacitor C1 at which the capacitor C1 is connected to the gate of the driving transistor T1, so that the gate of the driving transistor T1 is reset to the ground potential GND.

Figure 4:
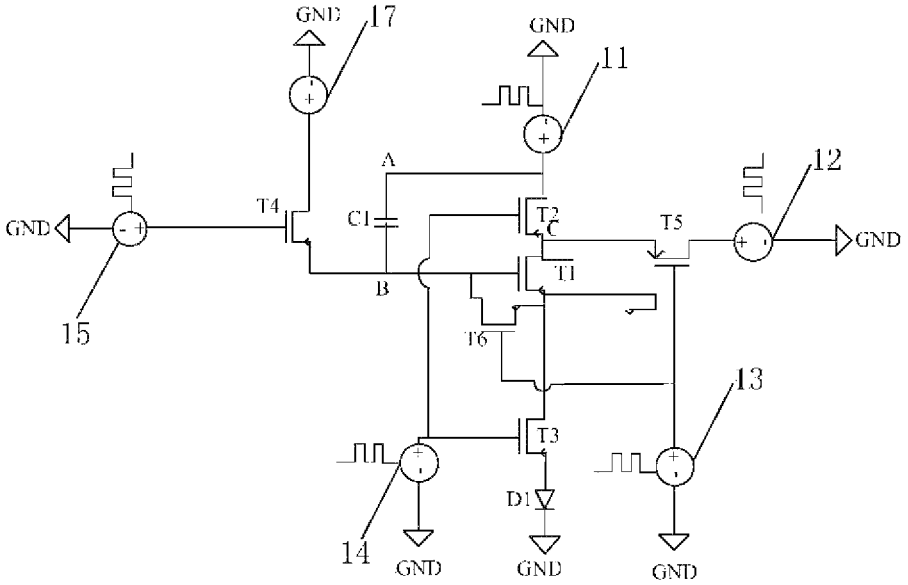
FIG. 4 is a schematic diagram showing another pixel circuit structure having a resetting function provided in an embodiment of the present disclosure.

As shown in FIG. 4, the reference reset voltage source in the embodiment of the present disclosure is a separate constant voltage source 17 outputting a voltage of $V_{ref}$.

The source of the reset transistor T4 is connected to the output terminal of the constant voltage source 17, the drain of the reset transistor T4 is connected to the gate of the driving transistor T1, and the gate of the reset transistor T4 is connected to the reset signal source 15.

When the pixel circuit is in the phase for resetting, the charging sub-circuit 1 controls the switching transistor T5 and the switching transistor T6 to be turned off, and the light-emitting signal source 14 in the light-emitting control sub-circuit 3 controls the switching transistor T3 and the switching transistor T2 to be turned off; the reset signal source 15 controls the reset transistor T4 to be turned on, and the voltage Vref supplied from the constant voltage source 17 is applied to the terminal of the capacitor C1 at which the capacitor C1 is connected to the gate of the driving transistor T1, so that the potential at the gate of the driving transistor T1 is reset to $V_{ref}$.

Figure 5:
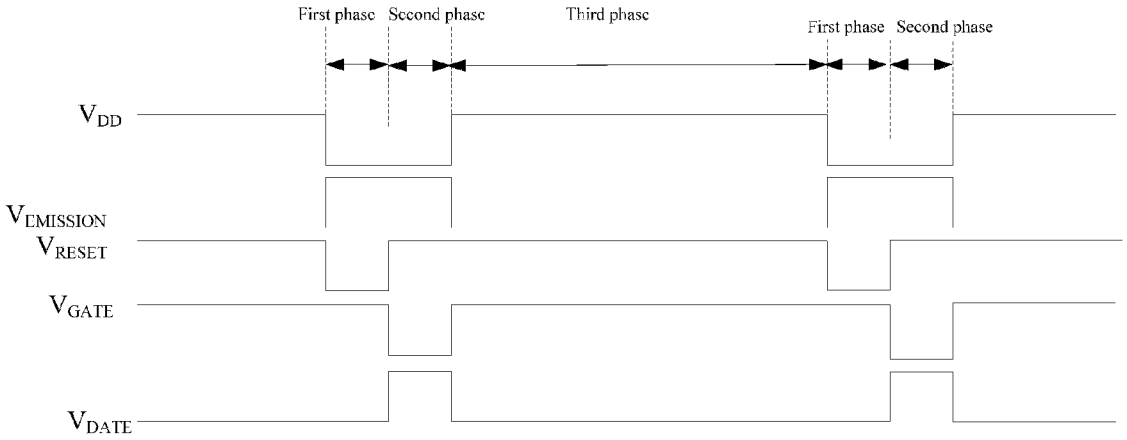
FIG. 5 is a timing diagram showing individual signals of the pixel circuit as shown in FIG. 3 in operation.

The principles of the individual modules in the pixel circuit provided in the embodiments of the present disclosure to achieve the corresponding functions are illustrated in detail in combination with the pixel circuit shown in FIG. 3 and the timing diagram of the pixel circuit shown in FIG. 5.

The pixel circuit has functions of resetting, writing data signal and driving OLED light-emitting, and accordingly, the pixel circuit operates in three operating phases, i.e., a phase for resetting, a phase for writing data signal, and a phase for emitting light.

The First Phase: The Phase for Resetting

Hereinafter the case in which the second terminal of the capacitor C1 is reset to the ground potential GND is taken as an example.

As shown in FIGS. 3 and 5, the voltage $V_{EMISSION}$ output from the light-emitting signal source 14 changes from a low level to a high level, and controls the switching transistor T2 and the switching transistor T3 connected to the light-emitting signal source 14 to be turned off.

The voltage $V_{GATE}$ output from the gate signal source 13 is at a high level, and controls the switching transistor T5 and the switching transistor T6 connected to the gate signal source 13 to be turned off.

The output voltage $V_{DATA}$ output from the data signal source 12 is at a low level, and no data signal is input to the pixel circuit, and a preparation is made for resetting the gate of the driving transistor T1.

The voltage $V_{RESET}$ output from the reset signal source 15 changes from a high level to a low level, and controls the reset transistor T4 to be turned on.

The voltage output from the reference signal source 11 changes from a high level ($V_{DD}$) to a low level (i.e., the ground potential GND), so that the potential at node B is pulled down to GND, and the gate of the driving transistor T1 (i.e., node B) is reset to GND.

The Second Phase: The Phase for Writing Data Signal

As shown in FIGS. 3 and 5, the voltage $V_{RESET}$ output from the reset signal source 15 changes from a low level to a high level, and the reset transistor T4 is turned off.

The voltage $V_{GATE}$ output from the gate signal source 13 changes from a high level to a low level, and controls the switching transistor T5 and the switching transistor T6 to be turned on.

The voltage $V_{DATA}$ output from the data signal source 12 is at a high level, and charges the capacitor C1.

The voltages output from the reference signal source 11 and the light-emitting signal source 14 remain the same levels as those in the first phase, that is, the voltage output from the reference signal source 11 is the ground potential GND and the voltage output from the light-emitting signal source 14 is at a high level.

Since the switching transistor T5 is turned on, the voltage at the node C is at the high level of $V_{DATA}$; the switching transistor T6 is turned on, which causes the gate and the drain of the driving transistor T1 which are connected electrically to the switching transistor T6 in conduction, so that the driving transistor T1 in this connection functions as a diode; based on the physical characteristics of the diode, the voltage at the node C is $V_{DATA}$, and the voltage at the node B is $V_{DATA}+V_{th}$ (the voltage at the node B is equal to the voltage $V_g$ at the gate of the driving transistor T1). It can be known, the voltage across the nodes A and B is $V_{DATA}+V_{th}$. At this time, the amount of the charges stored in the capacitor C1 corresponds to the voltage $V_{DATA}+V_{th}$.

The Third Phase: The Phase for Emitting Light.

As shown in FIGS. 3 and 5, the voltage $V_{GATE}$ output from the gate signal source 13 changes from a low level to a high level, and the switching transistor T5 and the switching transistor T6 are turned off. The driving transistor T1 in this connection is restored to function as a triode.

The voltage $V_{DATA}$ output from the data signal source 12 changes from a high level to a low level.

The voltage $V_{RESET}$ output from the reset signal source 15 still remains at a high level, so that the reset transistor T4 is turned off.

The voltage output from the reference signal source 11 changes from the ground potential GND to a high level $V_{DD}$.

The voltage $V_{EMISSION}$ output from the light-emitting signal source 14 changes from a high level to a low level, so that the switching transistor T2 and the switching transistor T3 are turned on.

After the switching transistor T2 is turned on, the potential at the node C changes to $V_{DD}$, and the potential at the node A changes to $V_{DD}$; according to the conservation law of charge, the potential at the node B changes to $V_{DD}+V_{DATA}+V_{th}$. Thus, the potential at the gate of the driving transistor T1 is $V_g=V_{DD}+V_{DATA}+V_{th}$, and the potential at the source of the driving transistor T1 is $V_S=V_{DD}$.

Since the driving transistor T1 operates in a saturation region, the current of the drain of the driving transistor T1 satisfies the formula as follows according to the characteristic of the current in the saturation region:

$$i_d = \frac{K}{2}(V_{gs} - V_{th})^2 \tag{1-1}$$

wherein $i_d$ represents the current flowing through the driving transistor T1, $V_{gs}$ represents the voltage across the gate and the source of the driving transistor T1, and K represents a parameter regarding structure and remains relative stable in the same structure.

$$V_{gs}=V_g-V_s=V_{DD}+V_{DATA}+V_{th}-V_{DD}=V_{th}+V_{DATA},$$

wherein $V_s$ represents the potential at the source of the driving transistor T1 (i.e., the node C), and $V_g$ represents the potential at the gate of the driving transistor T1 (i.e., the node B).

$$i_d = \frac{K}{2}(V_{gs} - V_{th})^2 = \frac{K}{2}(V_{DATA})^2 \tag{1-2}$$

It can be known from the above formula (1-2), the current $i_d$ flowing through the driving transistor T1 only depends on $V_{DATA}$ supplied from the data signal source 12, and is independent of $V_{th}$ and $V_{DD}$. The current $i_d$ drives the OLED D1 to emit light, and the current flowing through the OLED can not vary with the non-uniformity of Vth due to the manufacturing process of the array substrate, so that there is no variation in luminance on the array substrate with the non-uniformity of $V_{th}$ due to the manufacturing process of the array substrate. On the other hand, there is no variation in the current flowing through the OLED with the VDD IR Drop due to the load on the signal line of $V_{DD}$. At the same time, the following issues can be addressed: since the current flowing through the OLED varies due to the decay of $V_{th}$, the luminance varies, and thus the stability of the OLED deteriorates.

Hereinafter, taking the case in which the individual switching transistors and the driving transistor T1 are n type transistors as an example, a structure of a pixel circuit provided in the embodiments of the present disclosure is illustrated.

Similar to the pixel circuit shown in FIGS. 2 and 3, the differences therebetween are in that the driving transistor T1 in the driving sub-circuit is an n type transistor, and that the reference signal source is a negative reference signal source for outputting a negative reference voltage $V_{SS}$, and that the voltage signal $V_{SS}$ lowers than the signal GND and $V_{th}$ is a positive value, and that the drain of the driving transistor T1 is connected to the cathode of the OLED D1.

Another pixel circuit provided in the embodiments of the present disclosure and the functions of individual modules in the pixel circuit are described respectively as follows.

Figure 6:
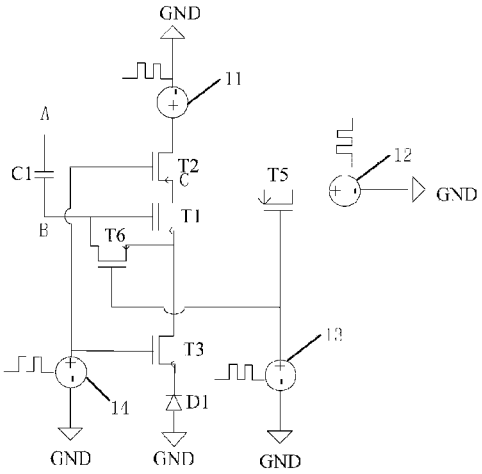
FIG. 6 is a schematic diagram showing another detailed pixel circuit structure provided in an embodiment of the present disclosure.

As shown in FIG. 6, the light-emitting control sub-circuit includes a light-emitting signal source 14, a switching transistor T3 and/or a switching transistor T2.

The switching transistor T3 has a source connected to the drain of the driving transistor T1, a drain connected to the cathode of the OLED D1, and a gate connected to an output terminal of the light-emitting signal source 14.

The switching transistor 12 has a source connected to the output terminal of the reference signal source 11, and a drain connected to the source of the driving transistor T1, and a gate connected to the output terminal of the light-emitting signal source 14.

In the case that the light-emitting control sub-circuit 3 only comprises the light-emitting signal source 14 and the switching transistor T3, the light-emitting signal source 14 controls the turning-on and turning-off of the switching transistor T3 to ensure that the OLED D1 connected to the switching transistor T3 is disconnected from the charging sub-circuit when the charging sub-circuit is in conduction, so that the OLED D1 does not emit light when the pixel circuit is in the phase for writing data signal.

In the case that the light-emitting control sub-circuit 3 only comprises the light-emitting signal source 14 and the switching transistor T2, the light-emitting signal source 14 controls the turning-on and turning-off of the switching transistor T2 to ensure that the driving transistor T1 connected to the switching transistor T2 is disconnected from the charging sub-circuit when the charging sub-circuit is in conduction, so that the driving transistor T1 is turned off when the pixel circuit is in the phase for writing data signal.

Preferably, the light-emitting control sub-circuit 3 comprises the light-emitting signal source 14, the switching transistor T3 and the switching transistor T2; when the pixel circuit is in the phase for writing data signal, the light-emitting signal source 14 controls the switching transistor T3 and the switching transistor T2 to be turned off, and the driving sub-circuit connected to the switching transistor T3 and the switching transistor T2 is in an open circuit state; and when the pixel circuit is in the phase for writing data signal, the voltage GND output from the reference signal source 11 is applied to the terminal of the capacitor C1 at which the capacitor C1 is connected to the reference signal source 11; the gate signal source 13 controls the switching transistor T5 and the switching transistor T6 to be turned on, which causes the gate and the drain of the driving transistor T1 which are connected to the source and the drain of the switching transistor T6 respectively in conduction; the data signal source 12 outputs a voltage $V_{DATA}$ corresponding to the data signal, and applies the voltage $V_{DATA}$ to the source of the driving transistor T1; the voltage at the gate of the driving transistor T1 is the sum of the voltage $V_{DATA}$ and the threshold voltage $V_{th}$ of the driving transistor T1, i.e., $V_{DATA}+V_{th}$, the voltage at the terminal of the capacitor C1 at which the capacitor C1 is connected to the gate of the driving transistor T1 is charged to $V_{DATA}+V_{th}$.

It should be noted that the pixel circuit can also exclude the switching transistor T3 and/or the switching transistor T2 of the light-emitting control sub-circuit, and in this case, the switching transistor T3 and/or the switching transistor T2 are/is replaced by wire(s) to realize conduction, and thus implementing the processes of writing data signal and emitting light. The function of the switching transistor T2 is to reduce and avoid the interference of the reference signal source 11 on the driving transistor T1 during the phase for writing data signal, such as the $V_{SS}$ IR Drop on the signal line of $V_{SS}$ due to the load on the signal line of $V_{SS}$. Similarly, the function of the switching transistor T3 is to reduce and avoid the influence of the voltage drop ($V_{oled}$) of the OLED D1 on the writing of the data signal during the phase for writing data signal.

As shown in FIG. 6, the charging sub-circuit 1 comprises a data signal source 12, a gate signal source 13, a switching transistor T5 and a switching transistor T6.

The switching transistor T5 has a source connected to an output terminal of the data signal source 12, a drain connected to the source of the driving transistor T1, and a gate connected to an output terminal of the gate signal source 13.

The switching transistor T6 has a source connected to the gate of the driving transistor T1, a drain connected to the drain of the driving transistor T1, and a gate connected to the output terminal of the gate signal source 13.

When the pixel circuit operates in the phase for emitting light, the light-emitting signal source 14 controls the switching transistor T3 and the switching transistor T2 to be turned on, and the branch connected to the switching transistor T3 and the switching transistor T2 is in conduction, and the reference signal $V_{SS}$ output from the reference signal source 11 is applied to the source of the driving transistor T1; at this time, due to the retention capability of the capacitor C1 for voltage, the voltage at the gate of the driving transistor T1 is $V_{SS}+V_{DATA}+V_{th}$, and thus the driving transistor T1 is turned on and the OLED D1 is driven to emit light.

Figure 7:
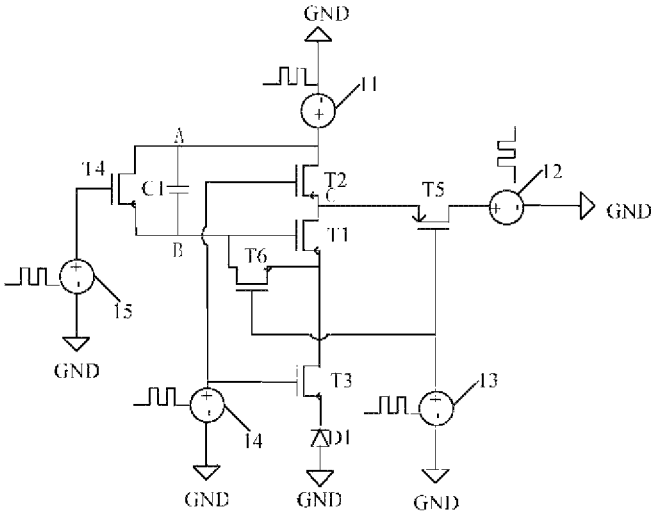
FIG. 7 is a schematic diagram showing a pixel circuit structure having a resetting function provided in an embodiment of the present disclosure.

As shown in FIG. 7, in order to guarantee that the signal of a previous frame has a minimum influence over the signal of a current frame, the pixel circuit provided in the embodiment of the present disclosure further includes a reset circuit for resetting the voltage across the capacitor C1 to a reference reset voltage before the charging sub-circuit 1 charges the capacitor C1.

The case in which the second terminal (i.e. the node B) of the capacitor is reset to GND is taken as an example for illustration as below.

The reset circuit comprises a reset signal source 15 and a reset transistor T4.

The source of the reset transistor T4 is connected to the output terminal of the reference signal source 11, the drain of the reset transistor T4 is connected to the gate of the driving transistor T1, and the gate of the reset transistor T4 is connected to the reset signal source 15.

When the pixel circuit is in the phase for resetting, the gate signal source 13 of the charging sub-circuit 1 controls the switching transistor T5 and the switching transistor T6 to be turned off, the light-emitting signal source 14 in the light-emitting control sub-circuit 3 controls the switching transistor T3 and the switching transistor T2 to be turned off, and the voltage GND supplied from the reference signal source 11 is applied to the terminal of the capacitor C1 at which the capacitor C1 is connected to the reference signal source 11.

The reset signal source 15 controls the reset transistor T4 to be turned on, and the voltage GND supplied from the reference signal source 11 is applied to the terminal of the capacitor C1 at which the capacitor C1 is connected to the gate of the driving transistor T1, so that the potential at the gate of the driving transistor T1 is reset to the ground potential GND.

Figure 8:
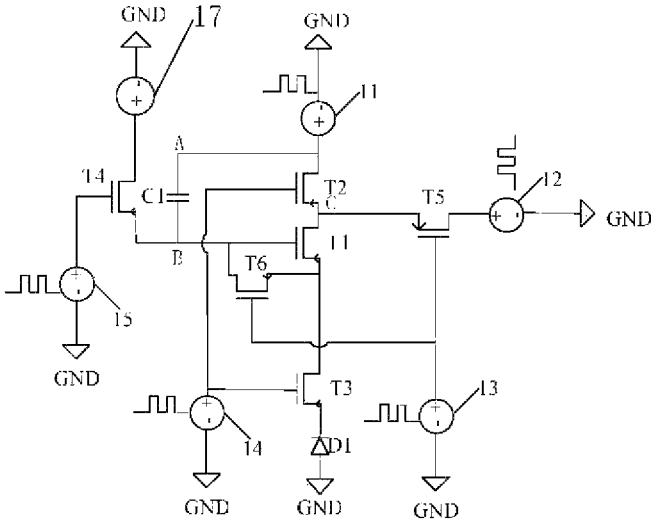
FIG. 8 is a schematic diagram showing another pixel circuit structure having a resetting function provided in an embodiment of the present disclosure.

Similar to the reset circuit in the pixel circuit corresponding to the p type driving transistor, the voltage at the source of the reset transistor T4 can be supplied with a separate constant voltage source. FIG. 8 shows the corresponding pixel circuit, wherein the source of the reset transistor T4 is connected to an output terminal of the constant voltage source 17.

The specific principle for implementation is the same as that in the reset circuit in the pixel circuit corresponding to the p type driving transistor, and the details are omitted.

Figure 9:
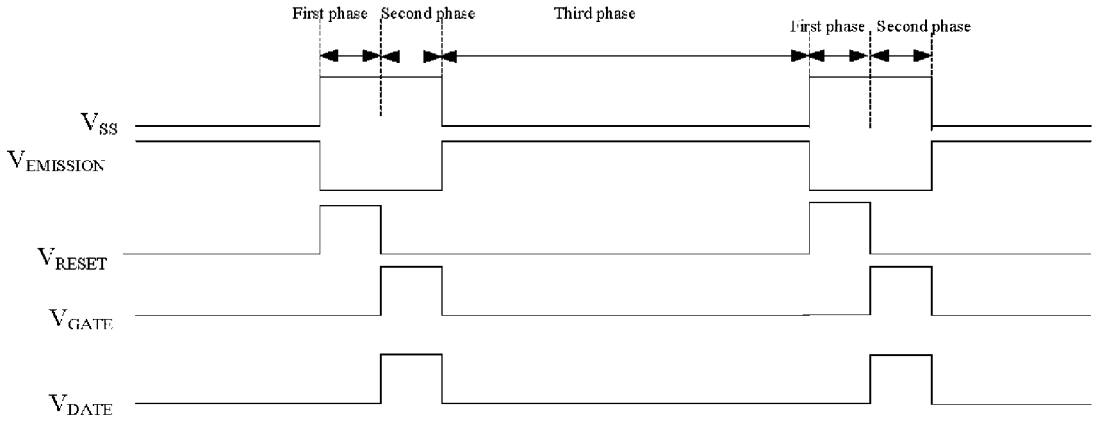
FIG. 9 is a timing diagram showing individual signals of the pixel circuit as shown in FIG. 7 in operation.

The operating principles of the pixel circuit in individual phases are described in sequence with reference to the structure of the pixel circuit and the timing diagram of the pixel circuit (as shown in FIG. 9).

The First Phase: The Phase for Resetting

As shown in FIGS. 7 and 9, the voltage V EMISSION output from the light-emitting signal source 14 changes from a high level to a low level, so that the switching transistor T2 and the switching transistor T3 connected to the light-emitting signal source 14 are turned off.

The voltage $V_{GATE}$ output from the gate signal source 13 is at a low level, and controls the switching transistor T5 and the switching transistor T6 connected to the gate signal source 13 to be turned off.

The voltage $V_{DATA}$ output from the data signal source 12 is at a low level.

The voltage $V_{RESET}$ output from the reset signal source 15 changes from a low level to a high level, and controls the reset transistor T4 to be turned on.

The voltage output from the reference signal source 11 changes from the low level Vss to the ground potential GND, so that the potential at node B is pulled up to the ground potential GND, and the gate of the driving transistor T1 (i.e., node B) is reset to the ground potential GND.

The Second Phase: The Phase for Writing Data Signal

As shown in FIGS. 7 and 9, the voltage $V_{RESET}$ output from the reset signal source 15 changes from a high level to a low level, and the reset transistor T4 is turned off.

The voltage $V_{GATE}$ output from the gate signal source 13 changes from a low level to a high level, and controls the switching transistor T5 and the switching transistor T6 to be turned on.

The voltage $V_{DATA}$ output from the data signal source 12 is at a high level, and charges the capacitor C1.

The voltages output from the reference signal source 11 and the light-emitting signal source 14 remain the same levels as those in the first phase, that is, the voltage output from the reference signal source 11 is the ground potential GND and the voltage output from the light-emitting signal source 14 is at a low level.

Since the switching transistor T5 is turned on, the voltage $V_{DATA}$ is applied to the node C; the switching transistor T6 is turned on, which causes the gate and the drain of the driving transistor T1 which are connected electrically to the switching transistor T6 in conduction, so that the driving transistor T1 functions as a diode in this connection, and the voltage at the node C is $V_{DATA}$, and the voltage at the node B is equal to $Vg=V_{DATA}+V_{th}$ (i.e., the voltage at the gate of the driving transistor T1 $V_g$). It can be known, the voltage across the nodes A and B is $V_{DATA}+V_{th}$.

At this time, the amount of the charges stored in the capacitor C1 corresponds to the voltage $V_{DATA}+V_{th}$. The voltage corresponding to the current data signal has been applied to the second terminal of the capacitor C1 (i.e. the node B).

The Third Phase: The Phase for Emitting Light.

As shown in FIGS. 7 and 9, the voltage $V_{GATE}$ output from the gate signal source 13 changes from a high level to a low level, and controls the switching transistor T5 and the switching transistor T6 to be turned off. The driving transistor T1 in this connection is restored to function as a triode.

The voltage $V_{DATA}$ output from the data signal source 12 changes from a high level to a low level, and stops the writing of the data signal.

The voltage $V_{RESET}$ output from the reset signal source 15 still remains a low level to control the reset transistor T4 to be turned off.

The voltage output from the reference signal source 11 changes from the ground potential GND to the low level $V_{SS}$.

The voltage $V_{EMISSION}$ output from the light-emitting signal source 14 changes from a low level to a high level, and controls the switching transistor T2 and the switching transistor T3 to be turned on.

After the switching transistor T2 is turned on, the potential at the node C changes to $V_{SS}$, and the potential at the node A changes to $V_{SS}$; according to the conservation law of charge, the potential at the node B changes to $V_{SS}+V_{DATA}+V_{th}$. Thus, the potential at the gate of the driving transistor T1 is $V_{SS}+V_{DATA}+V_{th}$, and the potential at the source of the driving transistor T1 is $V_S=V_{SS}$.

Since the driving transistor T1 operates in a saturation region, the current flowing through the driving transistor T1 satisfies the formula as follows according to the characteristic of the current in the saturation region:

$$i_d = \frac{K}{2}(V_{gs} - V_{th})^2 \tag{1-3}$$

wherein $i_d$ represents the current flowing through the driving transistor T1, $V_{gs}$ represents the voltage across the gate and the source of the driving transistor T1, and K represents a parameter regarding structure and remains relative stable in the same structure.

$$V_{gs}=V_g-V_s=V_{SS}+V_{DATA}+V_{th}-V_{SS}=V_{th}+V_{DATA},$$

wherein $V_s$ represents the potential at the source of the driving transistor T1 (i.e., the node C), and $V_g$ represents the potential at the gate of the driving transistor T1 (i.e., the node B).

$$i_d = \frac{K}{2}(V_{gs} - V_{th})^2 = \frac{K}{2}[(V_{th} + V_{DATA}) - V_{th}]^2 = \frac{K}{2}(V_{DATA})^2 \tag{1-4}$$

The current $i_d$ of the driving transistor T1 drives the OLED D1 to emit light. It can be known from the above formula (1-4), the current $i_d$ flowing through the driving transistor T1 only depends on the voltage signal supplied from the data signal source 12, and is independent of $V_{th}$ and $V_{SS}$. The current $i_d$ flows through the OLED D1 to drive the same to emit light, and the current flowing through the OLED can not vary with the non-uniformity of Vth due to the manufacturing process of the array substrate, so that there is no variation in luminance on the array substrate with the non-uniformity of $V_{th}$ due to the manufacturing process of the array substrate. On the other hand, there is no variation in the current with the $V_{SS}$ IR Drop due to the load on the signal line of $V_{SS}$. At the same time, the following issues can be addressed: since the current flowing through the OLED varies due to the decay of Vth, the luminance varies, and thus the stability of the OLED deteriorates.

The embodiments of the present disclosure further provide a display apparatus comprising the pixel circuit mentioned above.

In summary, the pixel circuit provided in the embodiments of the present disclosure can make the voltage for driving the OLED D1 not only independent of the reference voltage (the reference voltage can be $V_{DD}$ or $V_{SS}$) but also independent of $V_{th}$. As a result, it prevents the current flowing through the OLED from varying with the non-uniformity of Vth due to the manufacturing process of the array substrate, and avoids a variation in the current flowing through the OLED with the IR Drop due to the load on the signal line of $V_{DD}$ or $V_{SS}$. At the same time, the following problems can be addressed: since the current flowing through the OLED and the luminance vary due to the decay of Vth, the stability of the OLED deteriorates.

It should be noted that the sources s and the drains d of various transistors (including the switching transistors and the driving transistor) have the same manufacturing processes and can be interchanged each other, and can be changed accordingly based on the direction of the voltage applied to. Furthermore, individual transistors in the same pixel circuit can be of the same type or different type, as long as the corresponding levels in timing sequence are adjusted according to the characteristics of the threshold voltages of their own. Preferably, the transistors which need the same gate turning-on signal source are of the same type. More preferably, all the transistors (including the switching transistors and the driving transistor) in the same pixel circuit are of the same type, i.e., n type transistors or p type transistors.

It should be appreciated for those skilled in the art that many modifications, variations or equivalences can be made in the embodiments of the present invention without departing from the spirit and the scope of the invention. Thus, provided that all the modifications and variations belong to the scope as claimed in the present invention and the equivalent technical means, such modifications and variations fall into the protection scope of the present invention as defined by the appended claims.

What is claimed is:

1. A pixel circuit comprising a charging sub-circuit, a driving sub-circuit, a reset circuit and a light-emitting control sub-circuit;

wherein the driving sub-circuit comprises a reference signal source, a driving transistor, a capacitor and a light-emitting device; one terminal of the capacitor is connected to a gate of the driving transistor, and the other terminal of the capacitor is connected to an output terminal of the reference signal source;

a first terminal of the light-emitting control sub-circuit is connected to the output terminal of the reference signal source, a second terminal of the light-emitting control sub-circuit is connected to a source of the driving transistor, a third terminal of the light-emitting control sub-circuit is connected to one terminal of the light-emitting device, and a fourth terminal of the light-emitting control sub-circuit is connected to a drain of the driving transistor; a first terminal of the charging sub-circuit is connected to the source of the driving transistor, a second terminal of the charging sub-circuit is connected to the drain of the driving transistor, and a third terminal of the charging sub-circuit is connected to the gate of the driving transistor;

the reset circuit comprises a reset signal source and a reset transistor, a source of the reset transistor is connected to the reference signal source, a drain of the reset transistor is connected to the gate of the driving transistor, and a gate of the reset transistor is connected to the reset signal source;

wherein the charging sub-circuit is used for charging the capacitor of the driving sub-circuit in a data writing phase, the light-emitting control sub-circuit is used for controlling the driving sub-circuit to be turned on so as to drive the light-emitting device to emit light in a light emitting phase;

wherein the reset transistor is turned on under the control of a reset signal from the reset signal source in a resetting phase, and so as to discharge the capacitor and reset the potential at the gate of the driving transistor to the reference signal source;

wherein during the resetting phase and the data writing phase, the output terminal of the reference signal source is at a ground potential GND, and during the light emitting phase, the output terminal of the reference signal source is at a first level different from the ground potential GND.

2. The pixel circuit of claim 1, wherein the charging sub-circuit comprises a data signal source, a gate signal source, a first switching transistor, and a second switching transistor;

a source of the first switching transistor is connected to an output terminal of the data signal source, a drain of the first switching transistor is connected to the source of the driving transistor, and a gate of the first switching transistor is connected to an output terminal of the gate signal source;

a source of the second switching transistor is connected to the gate of the driving transistor, a drain of the second switching transistor is connected to the drain of the driving transistor, and a gate of the second switching transistor is connected to the output terminal of the gate signal source;

the gate signal source is used for controlling the first switching transistor and the second switching transistor to be turned on, so that the driving transistor connected to the first switching transistor and the second transistor is turned on; the charging sub-circuit is used for charging the capacitor connected to the gate of the driving transistor.

3. The pixel circuit of claim 2, wherein the light-emitting control sub-circuit comprises a light-emitting signal source, a third switching transistor and a fourth switching transistor;

a source of the third switching transistor is connected to the drain of the driving transistor, a drain of the third switching transistor is connected to an anode of the light-emitting device, and a gate of the third switching transistor is connected to an output terminal of the light-emitting signal source;

a source of the fourth switching transistor is connected to the output terminal of the reference signal source, a drain of the fourth switching transistor is connected to the source of the driving transistor, and a gate of the fourth switching transistor is connected to the output terminal of the light-emitting signal source;

the light-emitting signal source is used for controlling the third switching transistor and the fourth switching transistor to be turned on, so that the driving circuit connected to the third switching transistor and the fourth switching transistor is turned on.

4. The pixel circuit of claim 1, wherein in the case that the driving transistor is a p type transistor, the anode of the light-emitting device is connected to the third terminal of the light-emitting control sub-circuit; in the case that the driving transistor is a n type transistor, a cathode of the light-emitting device is connected to the third terminal of the light-emitting control sub-circuit.

5. A display apparatus comprising the pixel circuit of claim 1.

6. The display apparatus of claim 5, wherein the charging sub-circuit comprises a data signal source, a gate signal source, a first switching transistor, and a second switching transistor;

a source of the first switching transistor is connected to an output terminal of the data signal source, a drain of the first switching transistor is connected to the source of the driving transistor, and a gate of the first switching transistor is connected to an output terminal of the gate signal source;

a source of the second switching transistor is connected to the gate of the driving transistor, a drain of the second switching transistor is connected to the drain of the driving transistor, and a gate of the second switching transistor is connected to the output terminal of the gate signal source;

the gate signal source is used for controlling the first switching transistor and the second switching transistor to be turned on, so that the driving transistor connected to the first switching transistor and the second transistor is turned on; the charging sub-circuit is used for charging the capacitor connected to the gate of the driving transistor.

7. The display apparatus of claim 6, wherein the light-emitting control sub-circuit comprises a light-emitting signal source, a third switching transistor and a fourth switching transistor;

a source of the third switching transistor is connected to the drain of the driving transistor, a drain of the third switching transistor is connected to an anode of the light-emitting device, and a gate of the third switching transistor is connected to an output terminal of the light-emitting signal source;

a source of the fourth switching transistor is connected to the output terminal of the reference signal source, a drain of the fourth switching transistor is connected to the source of the driving transistor, and a gate of the fourth switching transistor is connected to the output terminal of the light-emitting signal source;

the light-emitting signal source is used for controlling the third switching transistor and the fourth switching transistor to be turned on, so that the driving circuit connected to the third switching transistor and the fourth switching transistor is turned on.

8. The display apparatus of claim 5, wherein in the case that the driving transistor is a p type transistor, the anode of the light-emitting device is connected to the third terminal of the light-emitting control sub-circuit; in the case that the driving transistor is a n type transistor, a cathode of the light-emitting device is connected to the third terminal of the light-emitting control sub-circuit.

* * * * *